US008625833B1

(12) United States Patent
Armwood

(10) Patent No.: US 8,625,833 B1
(45) Date of Patent: Jan. 7, 2014

(54) PORTABLE PRESSURIZATION HEADPHONES

(71) Applicant: Kenneth Armwood, Sparta, NJ (US)

(72) Inventor: Kenneth Armwood, Sparta, NJ (US)

( * ) Notice: Subject to any disclaimer, the term of this patent is extended or adjusted under 35 U.S.C. 154(b) by 0 days.

(21) Appl. No.: 13/710,516

(22) Filed: Dec. 11, 2012

(51) Int. Cl.
*H04R 25/00* (2006.01)

(52) U.S. Cl.
USPC ..... 381/371; 381/370; 381/373; 381/374

(58) Field of Classification Search
USPC ..... 381/72, 74, 370–383
See application file for complete search history.

(56) References Cited

U.S. PATENT DOCUMENTS 5,024,612 A 6/1991 van den Honert
5,419,762 A 5/1995 Arick
5,819,745 A 10/1998 Mobley
6,820,717 B2 11/2004 Fleming
2010/0071707 A1 3/2010 Wohl

*Primary Examiner* — Suhan Ni

(74) *Attorney, Agent, or Firm* — Daniel Boudwin; Global Intellectual Property Agency, LLC

(57) ABSTRACT

A portable headset for equalizing air pressure across the tympanic membrane of a user's ears. The device comprises two earpieces secured at opposing ends of a headband. The earpieces are cup-shaped housings containing a fan and a speaker. A mesh screen covers the open portion of the housing to protect the user's ear from contact with the fan blades. Additionally, a cushion is disposed along the perimeter of the housing to buffer the user's ear from the device. When the device is turned on, the fans rotate and air is pushed into or pulled out of the ear canals. Rate of rotation and direction of rotation are controlled via at least one pressurization selection dial. Thus the air pressure can be changed as a plane ascends or descends through the atmosphere.

8 Claims, 4 Drawing Sheets

PORTABLE PRESSURIZATION HEADPHONES

BACKGROUND OF THE INVENTION

1. Field of the Invention

The present invention relates to a pair of air pressurizing headphones. More specifically, it pertains to a headset having two fans directed towards a user's ear canal, for equalizing air pressure across the tympanic membrane of a user's ear. The invention is particularly useful in airplane cabins or for climbers at high altitudes.

Air travellers and high altitude climbers often experience a popping sensation within their ears. This popping is a result of air pressure stabilization across the membranes of a user's ears. The tympanic membrane, or "eardrum" is a thin membrane that helps to transmit sound. Air pressure is exerted on both sides of the eardrum; with the surrounding atmosphere pressure pushing it inwards while air being delivered via a tube between the back of your nose and the eardrum pushes it outwards. This narrow tube is called the Eustachian tube. When a person swallows the tube opens and a small bubble of air is able to move causing a 'pop'.

Rapid altitude changes in planes make the 'pop' much more noticeable due to bigger differences in pressure. Air pressure decreases as a plane ascends; hence air must exit the Eustachian tubes to equalize these pressures, again causing a 'pop'. Conversely, as a plane descends, the air pressure starts to increase; therefore the Eustachian tubes must open to allow more air to flow through, in order to equalize the pressure again, causing another 'pop'. If the tissue of the sinuses, throat, or ear are irritated, infected or swollen, then it may be difficult for air to pass through the Eustachian tubes. Air becomes trapped on either side of the Eustachian tubes and pressure is exerted on the eardrum. This can cause moderate to severe pain for the traveller.

Common methods of relieving the ear pain associated with changing air pressure involve forcing air out of the lungs and into the ears, chewing candy, and taking nasal decongestants. The practice of closing the nose and mouth and blowing outward to force air through the Eustachian tubes can be dangerous to the eardrums. If a person exerts too much force, the eardrums can tear or rupture, leading to extreme pain and the potential for long term hearing loss. The chewing of candy or gum is a viable option for many people, but can cause problems for children, the elderly, and those who lack proper musculoskeletal structure in the jaw. The last option, decongestant sprays and nasal medications, has become impractical in the wake of the heightened security measures imposed after the Sep. 11, 2001 attacks. Many airports no longer permit travellers to bring aerosol sprays or non-prescription medication onboard an airplane, The medicines may be checked into the storage luggage, but may not be carried on the plane, rending the medications useless to the traveller while the plane is in the air. A solution is needed that assists travellers with relieving the build-up of air pressure in the ears without requiring substantial jaw movement, or the use of medications.

2. Description of the Prior Art

The present invention provides a set of headphones with an adjustable headband and cushioned earpieces. Fans inside the earpieces push or pull air into and out of the ear canal of a user creating a change in in air pressure within the ear canal. This decrease in pressure stabilizes the air pressure across the user's tympanic membrane. The rate at which air is blown into the user's ear can be adjusted via a selection dial. Speakers are also provided so that a user can listen to music when the fans are off, The prior art discloses a number of earplugs that are inserted into the ear and depressed to create a vacuum, but none of these devices discloses a headband, electrically powered fans, or the ability to play sounds.

Most of the prior art devices that address ear pain from rapid pressure changes use an ear canal sealing member and a compressible bladder to change the pressure within the ear canal. The sealing member is inserted into the user's ear canal and the bladder is depressed to force air into the canal, resulting in outward pressure against the eardrum. Compression of the bladder prior to insertion into the ear canal results in the creation of a vacuum upon release of the bladder. A version of this device is disclosed by Wohl, U.S. Patent Application Publication No. 2010/0071707. The Wohl device discloses an earplug with multiple flanged members to help keep the earplug in place within the ear. An ovular bladder is disposed at one end of the earplug and a tunnel extends between the bladder and the tip of the earplug to permit air to travel from the bladder into the ear canal. A similar device is shown in Fleming, U.S. Pat. No. 6,820,717. This device is an elongated earplug with an internal cavity extending from the body of the plug through the inserted tip. The earplug is placed within the ear during landing of a plane and decreases pressure on the eardrum via slow compression of the cavity. Yet another collapsible bulb device is taught by Van Den Honert, U.S. Pat. No. 5,024,612, which differs from Wohl and Fleming in that it has an accordion or bulb style compressible bladder.

Pressure regulating earplugs with more complex structure involve parts that filter the transfer of air within the earplug to create slow increases and decreases in pressure. One such device is disclosed in Mobley, U.S. Pat. No. 5,819,745. The Mobley device comprises an elongated earplug having a flanged tip to seal the ear canal while the earplug is in place. A channel runs from the tip of the earplug through the device and out the opposing end. Within the channel a pressure regulator such as a piece of porous metal or ceramic, slows the flow of air into the ear canal. This air regulator helps prevent air from building up and pressing on the eardrum during plane take off and landing.

Alternative pressure regulating devices attempt to control the flow of air through other parts of a user's sinuses. One apparatus uses a handheld air pump and two nasal plugs to insert air into the user's sinus cavity, and resultantly through the Eustachian tubes. Arick, U.S. Pat. No. 5,419,762 teaches such a device. The handheld air pump may be manually or electrically powered. It process compressed air into the nostrils of a user via conduits running through two nasal plugs. This air is forced through the Eustachian tubes, causing the user's ears to pop.

These prior art devices have several known drawbacks. Each of them requires plugging an orifice via insertion of a sealing member into the orifice. The earpieces of the present invention surround the user's ear rather than requiring insertion into the ear canal. Insertion of items into the ear or nose can be dangerous if not done properly, and creates unsanitary conditions within the orifice by introducing bacteria to sensitive tissues. Additionally, none of these devices is held in place by a headband, to reduce the likelihood that the pressurization device will fall out of the ear or nose at an inopportune time. The present invention provides a headband that holds the earpieces close to a user's head The devices known in the prior art do not permit selective adjustment of the pressure generated by the device. A pressurization selection dial is provided that permits users to increase or decrease the strength at which the fans blow. This features important because not all users have inner ear structures of the same size and shape and thus require different levels of air pressure to achieve a comfortable equilibrium. The present invention is thus an adjustable headset that facilitates air pressure regulation across the tympanic membrane of a user's ear. It substantially diverges in design elements from the prior art and consequently it is clear that there is a need in the art for an improvement to existing sinus pressure regulating devices. In this regard the instant invention substantially fulfills these needs.

SUMMARY OF THE INVENTION

In view of the foregoing disadvantages inherent in the known types of sinus pressure regulating devices now present in the prior art, the present invention provides a new adjustable pressure regulating means, and securing headband wherein the same can be utilized for providing convenience for the user when adjustably regulating air pressure around the user's eardrums.

The present invention provides an easy to use means for regulating pressure within the ear canals, without requiring the insertion of objects into the ears. The invention is a headset with an adjustably sized headband and two earpieces, each located at an opposing end of the headband. Within each earpiece is a fan attached to and revolving around a hollow supporting tunnel. A speaker is located at the end of the support tunnel, in the center of the fan. The fan and speaker are directed towards an open end of the earpiece, which is covered by a mesh and surrounded by a plush ring. Leather, fabric or plastic may be used as a cover for the ring, and comfort is ideal because this ring is pressed against the user's ear to create a snug fit between the ear and the earpiece.

The fans and speakers can be used together or separately according to the mode of operation selected by the user. Operational modes may be selected via the power switch, which slides into positions corresponding to different modes. Alternatively the power switch may be separate from a mode control button. Another control is the pressure regulation dial that provides users with a means to increase or decrease the speed and direction of the earpiece fans, thereby pulling or pushing air out of or into the ear canal as a desired rate. Optimal pressurization rates will vary according to the size, shape, and condition of a user's eardrums. For example a small child may desire less pressurization than a fully-grown adult. Likewise, those with ear infections or sensitive ear structures may desire a lesser amount of airflow.

It is therefore an object of the present invention to provide a new and improved ear pressure regulation device that has all of the advantages of the prior art and none of the disadvantages.

It is therefore an object of the present invention to provide a means for regulating air pressure changes across the tympanic membrane without necessitating insertion of objects into the ear.

Another object of the present invention is to provide an ear pressure regulation device that can also be used for listening to music and audio.

Yet another object of the present invention is to provide an ear pressure regulation device that can be safely used with small children and the elderly because it does not introduce bacteria into the ear canal.

Still another object of the present invention is to provide an ear pressure regulation device in which a user can adjust the rate of pressurization.

A further object of the present invention is to provide an ear pressure regulation device having an electrically powered pressurization means that does not require a user to manually exert force on the device.

A still further object of the present invention is to provide an ear pressure regulation device that is easy to apply and remove.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
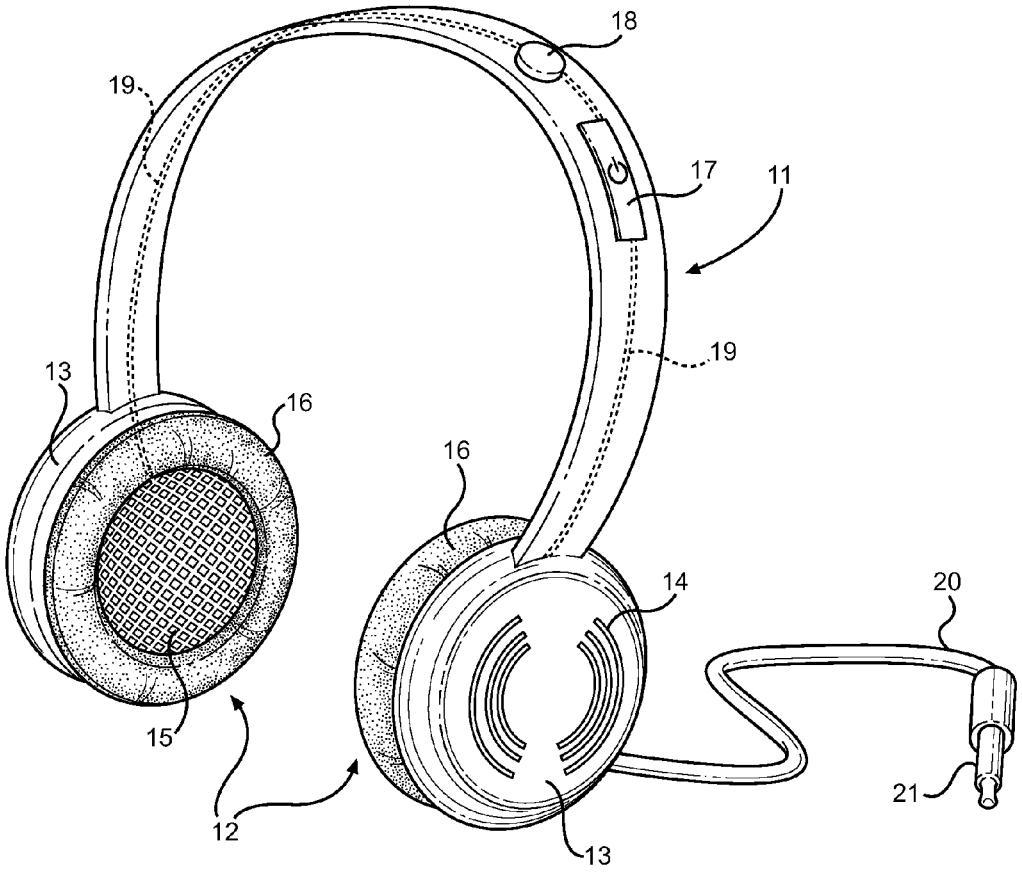
FIG. 1 shows a perspective view of the primary embodiment of the ear pressure regulation headset.

Reference is made herein to the attached drawings. Like reference numerals are used throughout the drawings to depict like or similar elements of the ear pressure regulation headset. For the purposes of presenting a brief and clear description of the present invention, the preferred embodiment will be discussed as used for equalizing air pressure across a user's inner ear structures. The figures are intended for representative purposes only and should not be considered to be limiting in any respect.

Referring now to FIG. 1, there is shown an ear pressure regulation headset with built-in speakers. This is the primary embodiment of the invention and does not include any secondary audio structures. The device comprises a headband 11 that is electrically connected to two earpieces 12 disposed at opposing ends of the headband. Each earpiece has a housing 13 that is generally cup shaped with an open portion and a closed portion. Air vents 14 are disposed along the closed portion of the housing to facilitate the flow of air through the housing, to the fan blades. Opposite the air vents, the open portion of the housing is an orifice covered by a mesh sheet 15 and surrounded by padded rings 16. The padded rings provide comfort to a user's ears and head while the device is being worn. Padding for the rings may be foam, rubber, or similar deformable materials, and should be wrapped in a soft or smooth material to reduce the likelihood of abrading the skin over periods of extended wear.

Figure 2:
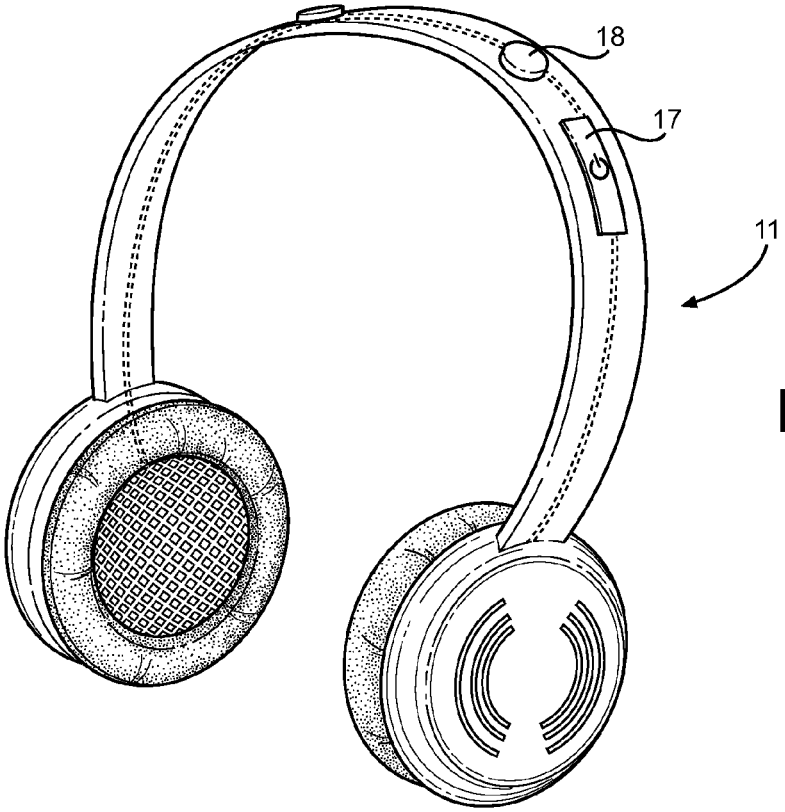
FIG. 2 shows a perspective view of an alternative embodiment of the device wherein the speaker system utilizes a wireless protocol such as Bluetooth to communicate with an audio device.

Controls are located on the headband to assist a user with manipulating the speed and direction that the internal fans blow. A power switch 17 controls the flow of power to the device. The switch may be a sliding switch, rocker switch or a depressible button. Another control means is the pressurization selection dial 18. This dial is turned to affect change in the rate at which the fans rotate or the direction of rotation, i.e. blowing air into the ear or pulling it away. In one embodiment there is a single pressurization selection dial that controls the speed and direction of rotation of the fans in both earpieces. This embodiment is useful to those who have healthy ear, nose and throat systems and have similarly sized inner ear structures (i.e., the tympanic membrane and Eustachian tubes). These people will be comfortable with the application of equal amounts of air pressure to both ear canals. For those users who are not comfortable with equal pressure application, and require a greater deal of customization, another embodiment includes a pressure selection dial for each side of the device. This embodiment is shown in FIG. 2. It will benefit users with damaged or infected ear structures who cannot tolerate large amounts of pressure. The alternative embodiment will also be useful to those who have ear structures of varied size, because the amount of pressure needed to equalize pressure across the tympanic membrane will be different for each of their ears.

The device has a cord 20 connected to a jack 21 that is plugged into a corresponding port on an audio output device such as mp3 player or smart phone. The jack may be an audio-visual (AV) jack or a male universal serial bus (USB) connector. Embodiments of the device that use an AV jack will require additional internal batty power to provide power to the fans and speakers. Conversely, in the USB connector embodiment, the additional battery sources are optional because the connector will draw power from the connected audio output device. It is recommended that internal batteries be included in the device to power the fans and speakers because the use of these elements can drain the battery life of a connected audio output device. In another alternative embodiment, shown in FIG. 2, the device is "wireless." It connects to an audio output device via a wireless data transmission protocol such as Bluetooth. This embodiment requires an onboard battery source, but will be advantageous when the user of the device is not the same person who controls the audio output device, such as with parents and children.

Figure 3:
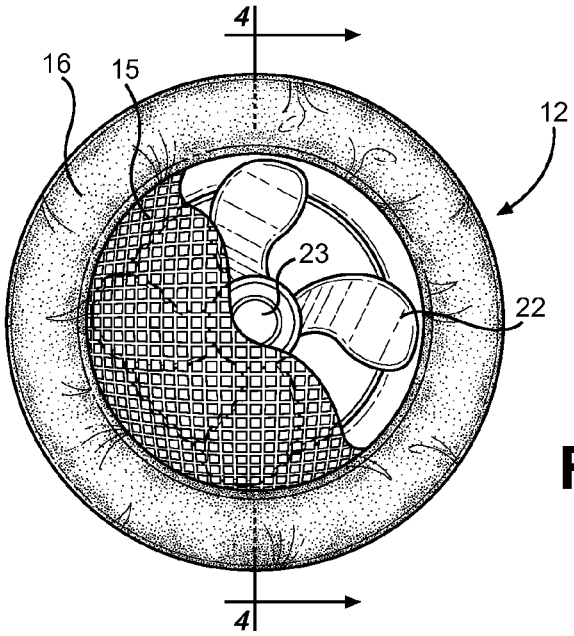
FIG. 3 shows a frontal view of an earpiece of the primary embodiment, with the fan connected to a centrally located speaker, and the assembly covered by a mesh.

Referring now to FIG. 3, there is shown a frontal cut-away view of an earpiece. The earpiece 12 comprises a cup-shaped housing with an open and closed portion. The open portion is covered by a mesh screen 15 and surrounded by a cushioned ring 16. A fan 22 is housed within the cup-shaped housing with the bladed portion disposed near the open portion of the housing. When the fan is turned on, the blades spin in the direction selected and push or pull air through the mesh screen. A user's selection via the pressure selection dial determines the direction and speed of rotation. In this way, air is blown into or pulled out of the ear canal, affecting a change in air pressure within the ear canal and creating a pressure equilibrium across the tympanic membrane. Located at the center of the fan is a speaker 23. The speaker is operatively connected to an exterior auto output device via the cord and jack (see FIG. 1.) or via a wireless transmission protocol (see FIG. 2). This feature allows travellers to use the device as a normal set of headphones when the fans are not in use. The user may optionally choose to turn audio playback on while the fans are on, to dull the sound of the spinning fans.

Figure 4:
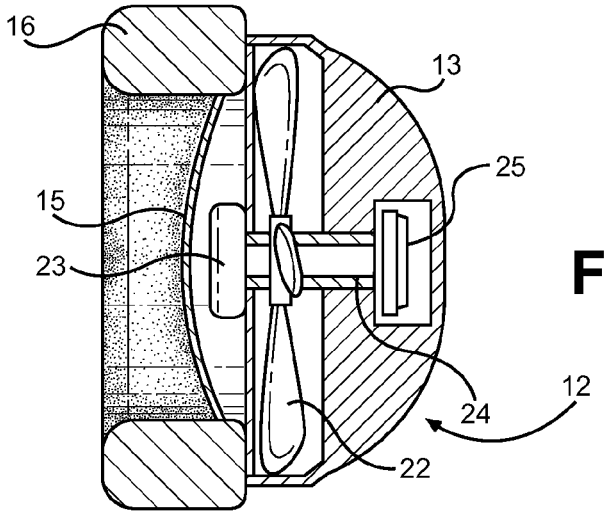
FIG. 4 shows a cross-section view of an earpiece of the primary embodiment.

A cross-sectional view of the earpiece is shown in FIG. 4. The earpiece 12 as a cup-shaped housing 13 with a closed portion and an open portion. The open portion has a mesh screen 15 covering and a cushioned ring 16 around the perimeter. A fan 22 is directed to located near and directed towards the open end of the housing. The shaft of the fan 25 extends through a tunnel 24 and is operatively connected to a power switch and a pressure selection dial (not shown) on the headband of the device. When the device is turned on, electricity flows to the earpiece and the fan shaft begins to rotate. A speaker 23 is also operatively connected to the power switch. The speaker is secured at the end of the fan shaft that is closest to the open end of the cup-shaped housing. Electrical connection for the speaker and power source may run through the fan shaft and out the rear end of the shaft. In the embodiment with a cord and associated jack, one or both speakers may be operatively connected to an external audio output device via an operative connection that runs through the fan shaft and out of the earpiece into the cord (see FIG. 1). Though the wiring linked to the speaker does not have to run through the fan shaft, this structure is contemplated because it isolates the wiring within the shaft and reduces the risk that the wiring will become entangled as the shaft turns.

In any embodiment, the purpose of the tunnel is to isolate the fan shaft and prevent it from perturbation while in use. Without restriction of the fan shaft, the fan blades could move in uneven patterns during use and could cause damage to the mesh screen and the user's ear. The interior volume of the housing that surrounds the tunnel may be empty or solid, depending on the manufacturing specifications. It is desired however, that small slits or vents be disposed along the rear of the housing in spatial connection with the fan blades, so that the blades can draw in or push air out through the back of the housing. Thus, if the space around the tunnel is solid, the shaft must be relatively hollow and connected to the air vents, to permit air to flow through the shaft to the blades. Alternatively, if the space around the tunnel is open, the air vents may be disposed along portions of the housing that are not spatially connected to the tunnel because air can pass freely through the interior volume between the vents and the fan blades.

Figure 5:
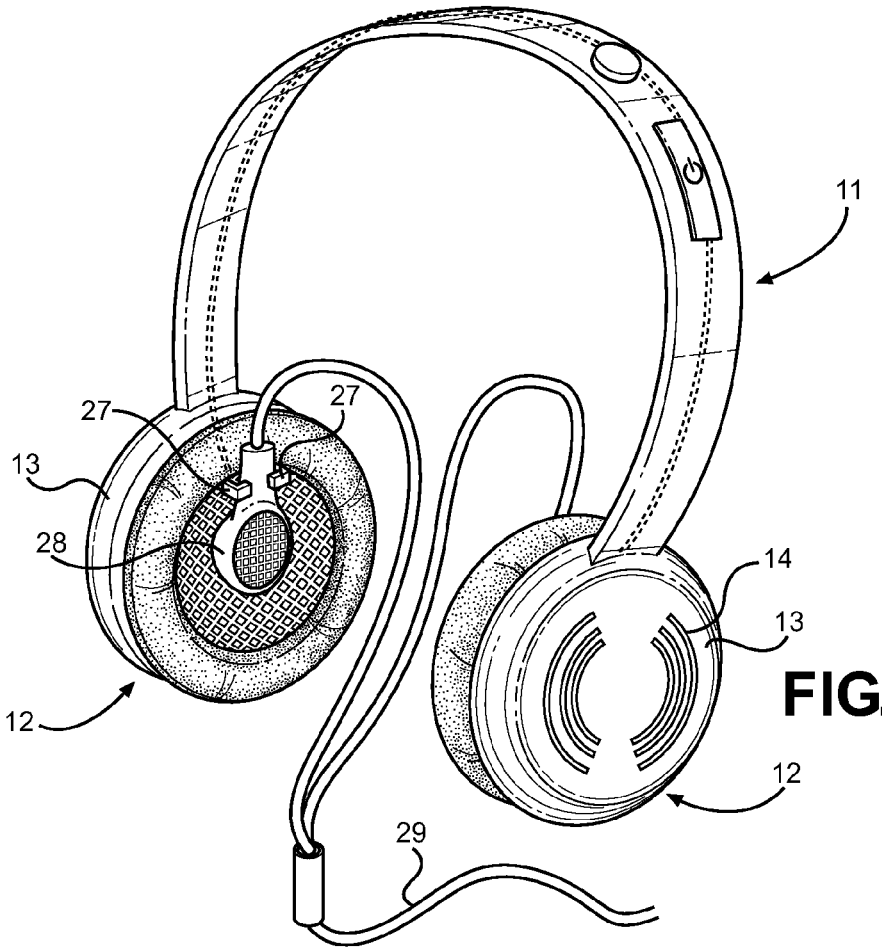
FIG. 5 shows a perspective view of an alternative embodiment of the present invention with detachable ear bud speakers.

An alternative embodiment of the device is shown in FIG. 5. As in the primary embodiment, the device has a headband 11 connected to two earpieces 12 that are disposed on opposing ends of the headband. The earpieces comprise a cup-shaped housing 13 having a closed and open portion. Along the rim of the open portion a speaker bracket 27 is attached and protrudes outward. Ear buds 28 from a set of headphones 29 are snapped into the speaker bracket and held in place over the open portion of the housing. This gives users audio output means without having to place the ear bud speakers directly in the ear canal, where they would block the flow of air from the device's fans. The removable speakers embodiment of the device will be appreciated by those who want to listen to audio while the fans are turned on. The attached ear bud speakers are positioned between the fans and the user's ear rather than being positioned in the center of the fan shaft. Emitted sound is less susceptible to distortion in this embodiment because sound waves will be travelling ahead of the air distorted by the fans rather than having to travel through the disturbed air.

Figure 6:
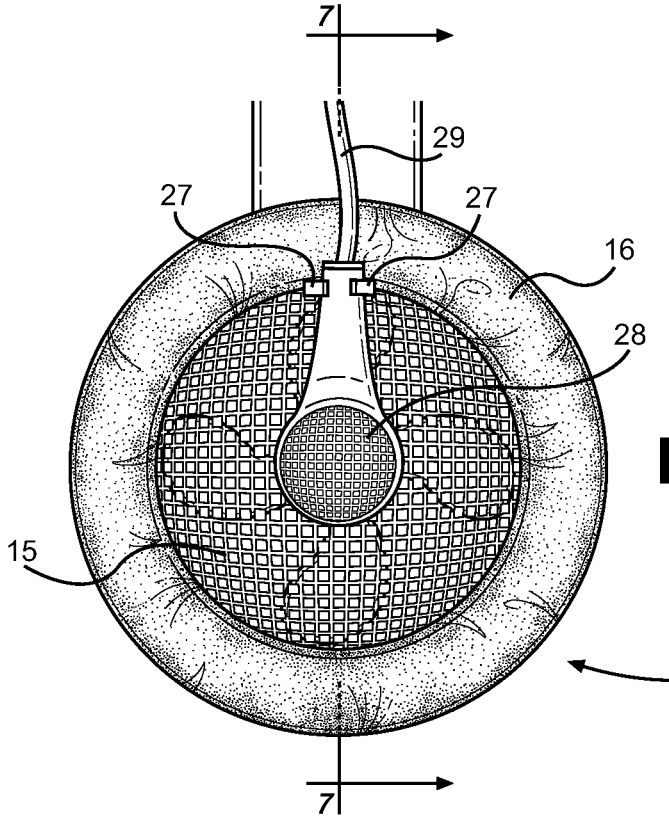
FIG. 6 shows a frontal view of the earpiece of the alternative embodiment with an ear bud speaker secured to the earpiece over the mesh. The fan is visible beneath the mesh.
Figure 7:
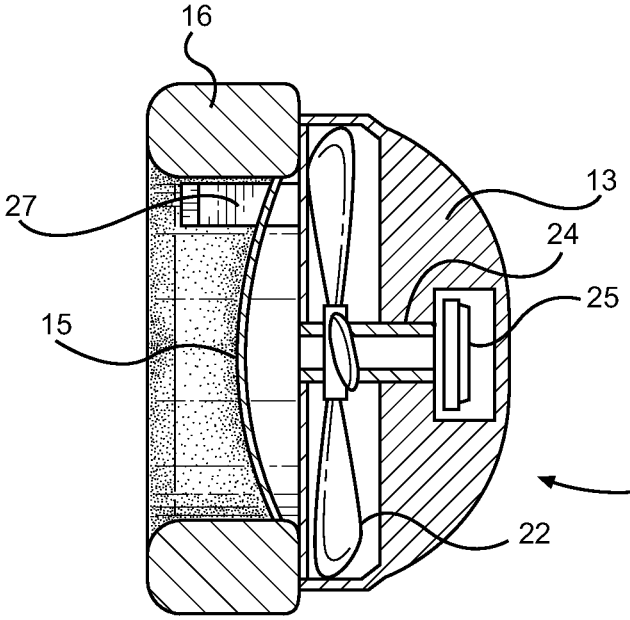
FIG. 7 shows a cross-sectional view of the earpiece of the alternative embodiment.

Turning now to FIGS. 6 & 7, a frontal view and cross-sectional view of the alternative earpiece embodiment is shown. The earpiece 12 has a mesh screen 15 secured over the open portion of the earpiece housing and is surrounded by a cushioned ring that provides a buffer between the earpiece and the user's ear. A speaker bracket 27 is secured to the exterior of the open portion and protrudes under the cushioned ring. The bracket should not extend out past the cushioned ring because this could result in the bracket being pressed into the tissue of a user's ear resulting in pain. An ear bug speaker 28 is held near the junction between the speaker and the headphone cord 29. When snapped in place, the speaker is suspended out front of the mesh screen in a position that is approximately central to the earpiece. The earpiece fan, located behind within the earpiece housing, blows through the mesh screen, around the ear bud speaker.

In use an individual places the headset on her head with the earpieces positioned over her ears. She can then plug the headset jack into an external audio output device to listen to music, an audiobook, or the like. To start the air pressure equalization process, the power is turned on via the power switch on the headband part of the headset. The fans in each earpiece will begin to rotate, consequently forcing air into or pulling it out of the ear canal area. At least one pressure selection dial is turned to adjust the speed at which the fans rotate or the direction they rotate. Once the user is comfortable with the air pressure entering or exiting the ears, she may relax and wait for the air pressure in her ears to equalize.

The present invention is a highly portable and sanitary air pressure equalization device for ears. The device uses earpieces with cushioned rings to create a closed area around the ear and then pushes air into or our of the ear via a fan. Fans are not inserted into the ear nor do they come in contact with the user's ear. This prevents bacteria from introduced into the ear and makes the device easily transferrable amongst users. Further, the device's external earpieces reduce the risk that a user will injure the ear canal during use because nothing is inserted into the ear cavities.

The device may be manufactured in a variety of different ways and structural variations. The earpiece housings and headband may be metal, plastic, rubber, or any other durable, lightweight material. Mesh screens may be metal, fabric, nylon or any other similarly flexible materials. A specific size and shape of the fan blades and speaker are not contemplated, and may be adjusted according to the specific size and shape of the manufactured device. Likewise the headband may be adjustable or come in a variety of predetermined sizes.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A headset for equalizing air pressure across the eardrum of a human ear, comprising:

a headband;

a power switch;

at least one pressure selection dial;

a pair of earpieces, disposed on opposing ends of said headband, said earpieces comprising a housing having an open portion and a closed portion with air vent apertures extending through said closed portion;

a pair of mesh screens covering said open portions of said housings;

a pair of cushion rings disposed along the perimeter of said open portions of said housings;

a pair of fans secured within said housings and operatively connected to said at least one pressure selection dial and said power switch.

2. The device of claim 1, wherein there are two pressure selection dials, each dial being operatively connected to a fan in one of said earpieces.

3. The device of claim 1, wherein said at least one pressure selection dial is disposed on said headband.

4. The device of claim 1, further comprising:

a speaker secured within said earpiece housings.

5. The device of claim 4, further comprising:

an audiovisual cord;

a connection jack;

said speakers are operatively connected to said audiovisual cord.

6. The device of claim 5, wherein said connection jack is an audiovisual jack.

7. The device of claim 4, further comprising:

a wireless transmission means, operatively connected to said speakers.

8. The device of claim 1, further comprising:

a speaker bracket secured to each of said open portion of said earpiece housings and extending outward therefrom.

* * * * *